US010770091B2

(12) United States Patent
Kleijn et al.

(10) Patent No.: US 10,770,091 B2
(45) Date of Patent: Sep. 8, 2020

(54) BLIND SOURCE SEPARATION USING SIMILARITY MEASURE

(71) Applicant: Google Inc., Mountain View, CA (US)

(72) Inventors: Willem Bastiaan Kleijn, Eastbourne (NZ); Sze Chie Lim, San Francisco, CA (US)

(73) Assignee: GOOGLE LLC, Mountain View, CA (US)

( * ) Notice: Subject to any disclaimer, the term of this patent is extended or adjusted under 35 U.S.C. 154(b) by 386 days.

(21) Appl. No.: 15/412,812

(22) Filed: Jan. 23, 2017

(65) Prior Publication Data

US 2018/0182412 A1 Jun. 28, 2018

Related U.S. Application Data

(60) Provisional application No. 62/439,824, filed on Dec. 28, 2016.

(51) Int. Cl.
*G10L 21/028* (2013.01)
*G10L 21/0308* (2013.01)

(52) U.S. Cl.
CPC ..... *G10L 21/0308* (2013.01); *G10L 21/028* (2013.01)

(58) Field of Classification Search
CPC ..... G10L 15/02
USPC ..... 704/239
See application file for complete search history.

(56) References Cited

U.S. PATENT DOCUMENTS

2008/0215651 A1* 9/2008 Sawada ..... G10L 21/0272 708/205
2012/0295649 A1* 11/2012 Kleijn ..... G10L 21/0272 455/500
2015/0206727 A1* 7/2015 Kopriva ..... G06K 9/0051 702/19
2015/0242626 A1* 8/2015 Wang ..... G06F 21/577 726/23
2018/0047407 A1* 2/2018 Mitsufuji ..... G10L 21/0272

FOREIGN PATENT DOCUMENTS

WO 2016/152511 A1 9/2016

OTHER PUBLICATIONS

W. Bastiaan Kleijn and Felicia Lim, Robust and Low-complexity blind source separation for meeting rooms, 2017 (Year: 2017).*
Shigeki Miyabe et al., Kernel-Based Nonlinear Independent Component Analysis for Underdetermined Blind Source Separation, Apr. 19, 2009, pp. 1641-1644. (Year: 2009).*
Abrard, et al., "A time-frequency blind signal separation method applicable to underdetermined mixture of dependent sources", Signal Processing, vol. 85, No. 7, 2005, pp. 1389-1403.
(Continued)

*Primary Examiner* — Huyen X Vo
*Assistant Examiner* — Timothy Nguyen
(74) *Attorney, Agent, or Firm* — Brake Hughes Bellermann LLP

(57) ABSTRACT

A method includes: receiving time instants of audio signals generated by a set of microphones at a location; determining a distortion measure between frequency components of at least some of the received audio signals; determining a similarity measure for the frequency components using the determined distortion measure; and processing the audio signals based on the determined similarity measure.

20 Claims, 3 Drawing Sheets

(56) References Cited

OTHER PUBLICATIONS

Bach, et al., "Spectral clustering for speech separation", Automatic Speech and Speaker Recognition, 2009, pp. 221-250.
Cohen, "Relative transfer function identification using speech signals", IEEE Transactions on Speech and Audio Processing, vol. 12, No. 5, Sep. 2004, pp. 451-459.
Comon, "Independent component analysis, a new concept?", Signal Processing, vol. 36, No. 3, 1994, pp. 287-314.
Frey, et al., "Clustering by passing messages between data points", Science, vol. 315, Feb. 16, 2007, pp. 972-976.
Gannot, et al., "Signal enhancement using beamforming and nonstationarity with applications to speech", IEEE Trans. Signal Processing, vol. 49, 2001, pp. 1614-1626.
Girolami, "Mercer kernel based clustering in feature space", IEEE Trans. Neural Networks, vol. 13, No. 3, 2002, pp. 780-784.
Gribonval, et al., "A survey of sparse component analysis for blind source separation: principles, perspectives and new challenges", 14th European Symposium on Artificial Neural Networks, 2006, pp. 323-330.
Hoshuyama, et al., "A robust adaptive beam-former for microphone arrays with a blocking matrix using constrained adaptive filters", IEEE Trans. Signal Processing, vol. 47, 1999, pp. 2677-2684.
Hyvaerinen, et al., "Independent component analysis: algorithms and applications", Neural networks, vol. 13, No. 4, 2000, pp. 411-430.
Li, et al., "Underdetermined blind source separation based on sparse representation", IEEE Transactions on Signal Processing, vol. 54, No. 2, Feb. 2006, pp. 423-437.
Ng, et al., "On spectral clustering: analysis and an algorithm", Advances in Neural Information Processing Systems, MIT Press, vol. 14, 2002, 8 pages.
Ozerov, et al., "Multichannel nonnegative matrix factorization in convolutive mixtures for audio source separation", IEEE Transactions on Audio, Speech, and Language Processing, vol. 18, No. 3, 2010, pp. 550-563.
Shalvi, et al., "System identification using nonstationary signals", IEEE Trans. Signal Processing, vol. 44, No. 8, Aug. 1996, pp. 2055-2063.
Shi, et al., "Normalized cuts and image segmentation", IEEE Trans. Pattern Anal. Mach. Intell., vol. 22, No. 8, 2000, pp. 888-905.
Van Dongen, "Graph clustering by flow simulation", Ph.D. dissertation, University of Utrecht, 2001, 173 pages.
Vlasblom, et al., "Markov clustering versus affinity propagation for the partitioning of protein interaction graphs", BMC Bioinformatics, vol. 10, No. 1, 2009, 14 pages.
Von Luxburg, et al., "A tutorial on spectral clustering", Statistics and Computing, vol. 17, No. 4, 2007, pp. 395-416.
Yilmaz, et al., "Blind separation of speech mixtures via time-frequency masking", IEEE Transactions on Signal Processing, vol. 52, No. 7, 2004, pp. 1830-1847.
International Search Report and Written Opinion for PCT/US2017/049926, dated Oct. 25, 2017, 8 pages.
Kleijn, et al., "Robust and Low-Complexity Blind Source Separation for Meeting Rooms", Hands-free Speech Communications and Microphone Arrays (HSCMA), 2017, pp. 156-160.
Miyabe, et al., "Kernel-based Nonlinear Independent Component Analysis for Underdetermined Blind Source Separation", International Conference on Acoustics, Speech and Signal Processing, 2009, pp. 1641-1644.

* cited by examiner

BLIND SOURCE SEPARATION USING SIMILARITY MEASURE

CROSS-REFERENCE TO RELATED APPLICATION

This application claims the benefit of the filing date of U.S. Provisional Patent Application No. 62/439,824, filed on Dec. 28, 2016 and entitled "BLIND SOURCE SEPARATION USING SIMILARITY MEASURE," the contents of which are incorporated herein by reference.

TECHNICAL FIELD

This document relates, generally, to blind source separation using a similarity measure.

BACKGROUND

Computer-based audio processing and management is sometimes performed on signals generated by a set of talkers who are talking at a meeting, such as in a dedicated meeting room. It is useful to be able to separate the speech associated with the individual talkers. For example, combined with speech recognition this would allow one to create a written record of a meeting fully automatically. Combined with other existing technology, this could also allow one to find passages where a particular person has a particular mood (e.g., happy, angry, sad). The method would facilitate the reduction of noise in a recording. For example, the method could have low computational complexity and high reliability.

SUMMARY

In a first aspect, a method includes: receiving time instants of audio signals generated by a set of microphones at a location; determining a distortion measure between frequency components of at least some of the received audio signals; determining a similarity measure for the frequency components using the determined distortion measure, the similarity measure measuring a similarity of the audio signals at different time instants for a frequency; and processing the audio signals based on the determined similarity measure.

Implementations can include any or all of the following features. Determining the distortion measure comprises determining a correlation measure of vector directionality that relates events at different times. The correlation measure includes a distance computation based on inner product. The similarity measure comprises a kernelized similarity measure. The method further includes applying a weighting to the similarity measure, the weighting corresponding to relative importance across a band of frequency components for a time pair. Multiple similarity measures are determined, the method further comprising generating a similarity matrix for the frequency components based on the determined similarity measures. The method further includes performing clustering using the generated similarity matrix, the clustering indicating for which time segments a particular cluster is active, the cluster corresponding to a source of sound at the location. Performing the clustering comprises performing centroid-based clustering. Performing the clustering comprises performing exemplar-based clustering. The method further includes using the clustering to perform demixing in time. The method further includes using the clustering as a pre-processing step. The method further comprises computing a mixing matrix for each frequency and then determining a demixing matrix from the mixing matrix. Determining the demixing matrix comprises using a pseudo-inverse of the mixing matrix. Determining the demixing matrix comprises using a minimum-variance demixing. The processing of the audio signals comprises speech recognition of participants. The processing of the audio signals comprises performing a search of the audio signal for audio content from a participant.

In a second aspect, a computer program product is tangibly embodied in a non-transitory storage medium, the computer program product including instructions that when executed cause a processor to perform operations including: receiving time instants of audio signals generated by a set of microphones at a location; determining a distortion measure between frequency components of at least some of the received audio signals; determining a similarity measure for the frequency components using the determined distortion measure, the similarity measure measuring a similarity of the audio signals at different time instants for a frequency; and processing the audio signals based on the determined similarity measure.

In a third aspect, a system includes: a processor; and a computer program product tangibly embodied in a non-transitory storage medium, the computer program product including instructions that when executed cause the processor to perform operations including: receiving time instants of audio signals generated by a set of microphones at a location; determining a distortion measure between frequency components of at least some of the received audio signals; determining a similarity measure for the frequency components using the determined distortion measure, the similarity measure measuring a similarity of the audio signals at different time instants for a frequency; and processing the audio signals based on the determined similarity measure.

Implementations can include the following feature. The similarity measure comprises a kernelized similarity measure.

BRIEF DESCRIPTION OF DRAWINGS

Like reference symbols in the various drawings indicate like elements.

DETAILED DESCRIPTION

This document describes examples of separating audio sources using a similarity measure. Some implementations provide robust, low-complexity demixing of sound sources from a set of microphone signals for a typical meeting scenario where the source mixture is relatively sparse in time. A similarity matrix can be defined that characterizes the similarity of the spatial signature of the observations at different time instants within a frequency band. Each entry of the similarity matrix can be the sum of a set of kernelized similarity measures for coefficients pairs of a time-frequency transform. The kernelization can result in high similarity resolution for similar time-frequency pairs and low similarity resolution for dissimilar time-frequency pairs. Clustering by means of affinity propagation can provide the separation of talkers. In some implementations, a single frequency band generally can work well, giving robust performance at low computational complexity. The clusters can be used directly for separation, or, to name another example, they can be used as a global pre-processing method that identifies sources for an adaptive demixing procedure that, for subsequent short time segment extracts each identified source that is active in that segment, given the interference to that source present in that time segment.

Sensors are sometimes used to observe a mixture of source signals. Blind source separation (BSS) is the art of separating out the source signals, with as its only assumption that these signals are statistically independent. In most BSS algorithms the additional assumption is made that the mixing is linear. In some implementations this assumption is made. For example, let $s \in \mathbb{C}^{P \times M}$ be a complex matrix describing P unknown discrete-time source signals over a time segment of length M. For $Q$ microphones, the observations $x \in \mathbb{C}^{Q \times M}$ can then be written as $$x = As, \tag{1}$$

where A is the mixing matrix. The equation (1) can describe any linear time-invariant mixing process, including convolutive mixing. For acoustic signals observed by microphones, equation (1) can be written separately for each frequency bin of a time-frequency representation, and that can motivate the use of complex signals.

Figure 1:
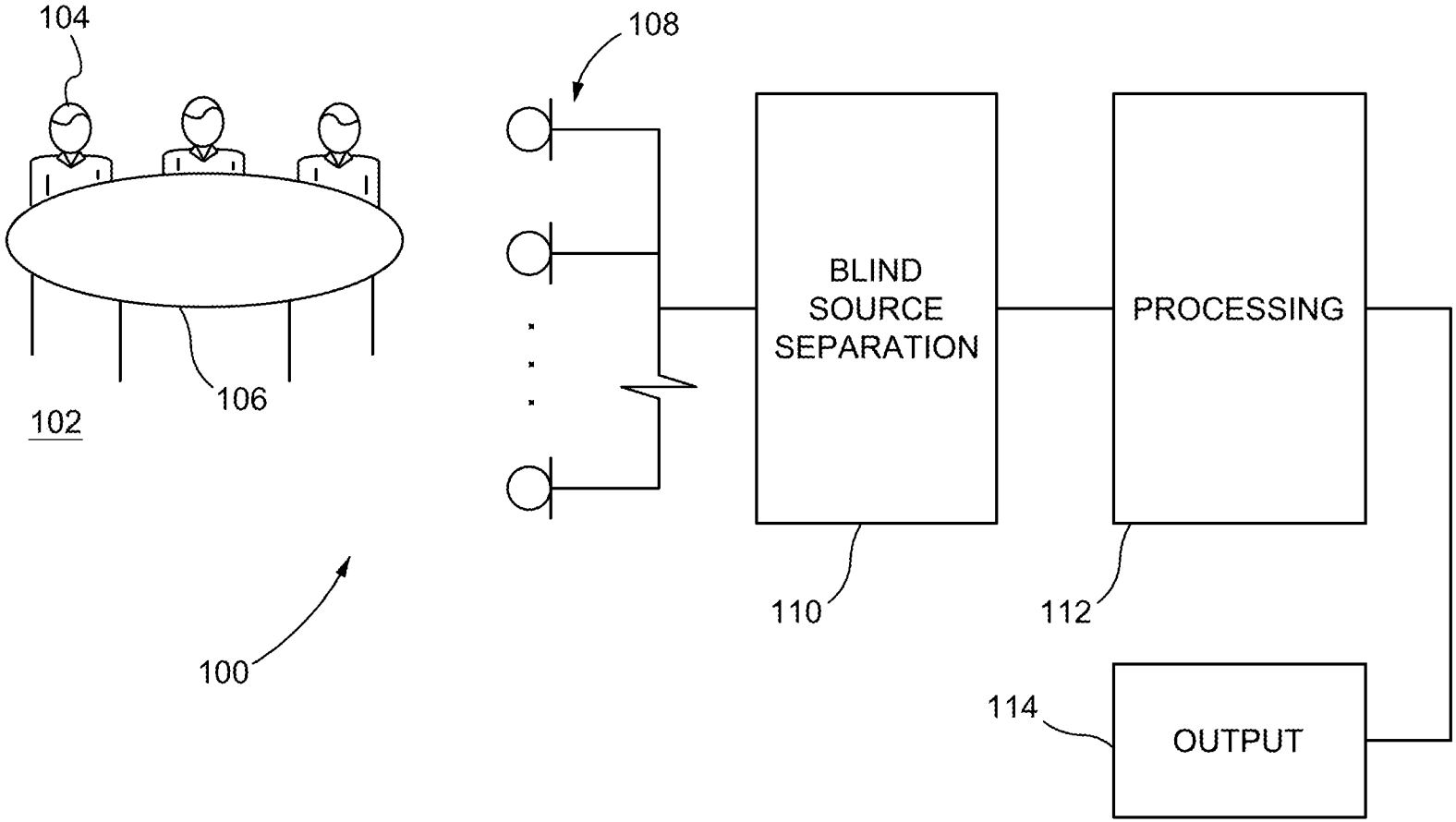
FIG. 1 shows an example of a system.

FIG. 1 shows an example of a system 100. At a meeting location 102, a number of talkers 104 are gathered around a table 106. Sound from one or more talkers can be captured using sensory devices 108, such as an array of microphones. The sensory devices 108 can deliver signals to a blind source separation module 110. For example, the blind source separation module 110 performs BSS. An output from the blind source separation module 110 can be provided to a processing module 112. For example, the processing module 112 can perform audio processing on audio signals, including, but not limited to, speech recognition and/or searching for a characteristic exhibited by one or more talkers. An output of the processing module 112 can be provided to an output device 114. For example, and without limitation, data or other information regarding processed audio can be displayed on a monitor, played on one or more loudspeakers, or be stored in digital form.

One known approach to BSS is independent-component analysis (ICA). It is aimed at extracting the independent sources when the source signals are active simultaneously. Such a dense-activity scenario leads to a relatively challenging separation task and often requires many data points. For the commonly used time-frequency representation, where equation (1) is solved separately for each frequency bin, the dense-activity scenario generally leads to the permutation ambiguity: it is undetermined how to group the separated signals across frequency. A drawback of the ICA method in particular is that it cannot handle Gaussian signals.

For many applications it may be appropriate to introduce assumptions additional to independence and linearity, reducing the difficulty of the separation task. This facilitates the use of fewer sensors and data, or provides increased robustness. Commonly used are the assumption that the mixture consists of nonnegative variables (as used in nonnegative matrix factorization) and the assumption that the signal is sparse. Some implementations can exploit the sparsity assumption, because it can allow a practical algorithm for the separation of speech signals with low computational complexity to be found.

The assumption of sparsity can commonly apply. To this purpose, an appropriate signal representation can be selected, as sparsity is strongly dependent on the signal representation. For example, the time-frequency representation of voiced speech is sparse, resulting in largely disjoint mixtures, but its time-domain representation is not. Sparse component analysis (SCA) can be performed. One approach is to write the source signals as $s = c\Phi$, where c is a sparse matrix, with non-zero coefficients of a particular row of c selecting a specific row from the dictionary matrix $\Phi$. More commonly, sparsity in s itself is used to solve equation (1).

An example of sparsity based BSS is the time-frequency ratio of mixtures (TIFROM) algorithm. For a particular frequency bin, a ratio vector is defined as the vector of observations normalized by the first entry. In the context of acoustic system identification the ratio vector is commonly referred to as the relative transfer function. Whenever the ratio vector is relatively constant over a time segment it is highly probable that a single source is active. This then allows for the computation of the row of the A matrix corresponding to that source. The TIFROM requirement for consecutive samples of a particular source in time can be relaxed. Once the matrix A is known, the signal s can be determined from the observations with the pseudo-inverse of A.

Some implementations can use a kernelized similarity measure to identify time-frequency observations that belong to different sources. A kernelized approach can facilitate flexibility in the similarity measure that separates the different sources and allowing operation over frequency bands rather than single frequency bins. This can be exploited for improved performance. Spectral clustering, a particular kernelized approach, can be used in the context of single-channel speech separation and in multichannel arrangements based on this principle. Some implementations are characterized in their kernel definition, the use of vector observations, and in the clustering method.

The following outlines and exemplifies a motivation for an implementation. Let x(k, m) be the observation vector at frequency k and time m. In the approach to BSS of some implementations one can first define $\mathcal{S}(x(k, m_1), x(k, m_2))$ as a kernelized measure of similarity between $x(k, m_1)$, $x(k, m_2)$. By aggregating the measures of similarity over a frequency band $\mathcal{K} = \{k_0, \ldots, k_0+K-1\}$, one can define a similarity matrix for that band:

$$\mathcal{S}_{\mathcal{K}}(m_1, m_2) = \sum_{k \in \mathcal{K}} \mathcal{S}(x(k, m_1), x(k, m_2)). \tag{2}$$

One can use the similarity matrix $\mathcal{S}_{\mathcal{K}}(m_1, m_2)$ to cluster observations of the frequency band $\mathcal{K}$ in time, for example using existing clustering procedures. Once the clusters have been extracted, the corresponding time segments can be used directly as the extracted signals, or they can be used to find the row of the mixing matrix A(k) that corresponds to the source, for all discrete frequencies k in the band. The demixing matrix can then be determined from the mixing matrix directly by way of a pseudo-inverse or another suitable matrix inversion method. Alternatively, one can consider the mixing matrix as a global description and then, for consecutive short signal blocks, extract each of the identified sources, when present in the block, using methods that describe the local remainder signal as interference, for example as described below.

Some implementations can provide at least three advantages over existing sparsity-based methods for finding a mixing matrix. First, a method can combine frequency bins within a frequency band $\mathcal{K}$ for clustering to obtain increased robustness. This may not assume that the mixing matrix A(k) is the same for all frequency bins k within the band. When the microphones are not spatially close, the transfer function may change rapidly as a function of frequency, rendering the assumption of a single mixing matrix over a frequency band inaccurate. Associated with the first advantage is the second advantage. If one aggregates the frequency bins over frequency bands prior to performing the clustering, the method may have low computational cost, despite the fact that one does not necessarily assume that the mixing matrices are constant over frequency. The third advantage may be that frequency bins that contain no relevant signal power can be included without negatively affecting performance. This may be a direct result of the kernelization of the similarity measures of the similarity coefficients. As the spatial signature of a source is largely determined by the relative phase of the components of the vectors, this can lead to robust performance. At least in principle, this robustness can be further improved by making the similarity measure $\mathfrak{s}(\bullet, \bullet)$ a function of signal power as outlined below.

Some implementations can be used for separating the speech of talkers in a meeting room. The demixed speech signals can then be attributed to a particular person, and speech recognition can be used to produce a transcript that shows who said what with the option of playing out the associated acoustic signal where desired. The method can form a platform for adding additional capabilities such as the search for time segments where a particular talker displays a particular emotion, which may be of value, for example, to journalists analyzing debates.

Figure 2:
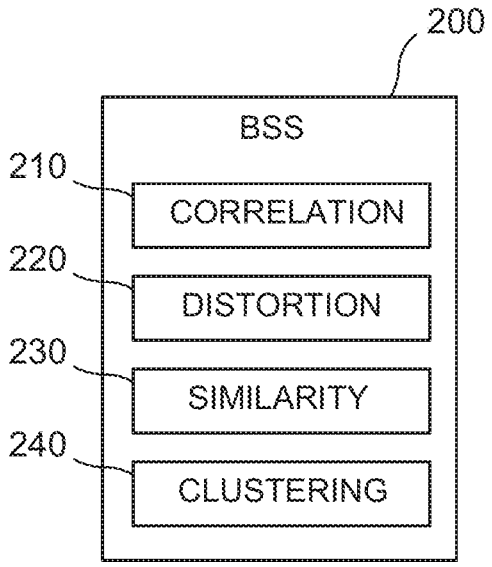
FIG. 2 shows an example of a blind source separation component.

The following describes a theory for at least some implementations. FIG. 2 shows an example of a blind source separation component 200. Consider a time-frequency vector signal with a discrete set $\mathcal{J}$ of frequencies. One can write the vector signal as $x: \mathcal{J} \times \mathbb{Z} \rightarrow \mathbb{C}$, where $Q$ describes the observation dimensionality. The vector signal is the linear time-invariant mixture of a set of source signals represented by the vector $s: \mathcal{J} \times \mathbb{Z} \rightarrow \mathbb{C}^P$ where P is the set of source signals. For each time-frequency bin (k, m) one can write $$x(k,m)=A(k)s(k,m). \tag{3}$$

where $A(k) \in \mathbb{C}^{Q \times P}$ is a frequency dependent mixing matrix, k is frequency and m is time. An objective can be to find A(k) from observations of x(k, m), and the knowledge that the components of the vector signal s(k, m) are statistically independent and sparse in the time-frequency representation.

The sparsity assumption can be natural for a time-frequency representation of speech as spoken in meeting environments. Voiced speech is sparse in frequency because of harmonicity. More importantly, speech has a large dynamic range, which implies that in a particular time-frequency bin a particular talker almost always dominates, even when multiple talkers talk simultaneously. Thus, when one considers the spatial signatures of frequency bins, they can usually be attributed to a particular talker. This property can also hold true, but to a lesser extent, if one uses frequency bands. It is this property that is exploited in the approach to BSS in some implementations.

The following describes an example of a definition of a similarity matrix. The aim of the similarity matrix of a signal segment can be to identify which signal segments within a band $\mathcal{K}$ are dominated by the same source signal (talker). A clustering algorithm operating on the similarity matrix identifies an appropriate set of sources, and when they are active. The main task in defining the similarity matrix can be the definition of a good distance measure between the observation vectors of different times within a particular frequency bin. The selection of the similarity matrix can be flexible and other similarity matrices than selected here may provide better performance.

One can first define the measure of similarity of two observations within a single frequency bin, $\mathfrak{s}$. The similarity measure $\mathfrak{s}$ aims to resolve the distinction between a signal vector generated by a first source and a signal vector generated by any second source. The overall similarity matrix (equation (2)) is an addition of terms. To obtain robust overall performance, outliers should not dominate this summation. This can be done by the proper design of the similarity measure % to be constructed such that outliers cannot occur. A natural measure of similarity for vector directionality can be correlation. While correlation is well-defined for real vectors, its analytic continuation to the complex case allows different choices. One can use $|x^H(k, m_1), x(k, m_2)|$, where $\bullet^H$ is Hermitian transpose. This choice has two desirable properties: i) it is commutative in the arguments and ii) it is invariant with the overall phase of each of the arguments, which varies with the source signal. One possible alternative is $\Re e(x^H(k, m_1), x(k, m_2))$. However, while consistent with the Euclidian distance measure $\|x(k, m_1)-x(k, m_2)\|_2^2=\|x(k, m_1)\|_2^2+\|x(k, m_2)\|_2^2-2\Re e(x^H(k, m_1)\, x(k, m_2))$ it is not invariant with source phase. The BSS component 200 can include a correlation component 210 that performs some or all of the above calculations.

Assuming the x(k, m) are normalized to have unit norm, one can then define a distortion measure $$D(x(k,m_1),x(k,m_2))=1-|x^H(k,m_1),x(k,m_2)|. \tag{4}$$

The BSS component 200 can include a distortion component 220 that performs some or all of the above calculations.

With the normalization, one can obtain the desired behavior with no outliers in the terms of equation (2) by using a Gaussian kernel:

$$\mathfrak{s}(x, (k, m_1), x(k, m_2)) = \alpha(k, m_1, m_2)e^{-\frac{D(x(k,m_1),x(k,m_2))}{Q\sigma^2}}, \tag{5}$$

where the variance $\sigma^2$ is a parameter that determines the decay behavior of the similarity measure and where $\alpha(k, m_1, m_2)$ is an optional weighting that can improve the robustness further.

In a basic implementation one can set $\alpha(k, m_1, m_2)=1$. Together, equations (5) and (2) can define a similarity matrix relating time instants in the frequency band $\mathcal{K}$. The BSS component 200 can include a similarity matrix 230 for some or all of the above calculations.

The similarity measure % of equation (5) can be any suitable kernel, including, but not limited to, a standard Gaussian kernel as used in equation (5), that can be used in the context of spectral clustering. One can interpret the method as a mapping to a high-dimensional feature space and a conventional inner-product based distance computation in this feature space. In some implementations, the Gaussian kernel is chosen, but other kernels can be used.

When used in the context of a frequency band $\mathcal{K}$ as defined in equation (2), the equation (5) can be augmented by using the weighting $\alpha(k, m_1, m_2)$ as a measure of relative importance across the band of the frequency components for a certain time pair $(m_1, m_2)$. The importance of a time-frequency vector is generally related to the relative loudness of that time-frequency vector. One measure of relative importance can provide a similar contribution to all vector pairs that have significant power relative to some noise power level $\gamma^2$. The noise level can be adapted or set to some fixed value. An effective example of such a relative importance measure is the sigmoid $$\alpha(k, m_1, m_2) = \frac{\alpha_0(k, m_1, m_2)}{\sum_{k\in\mathcal{K}} \alpha_0(k, m_1, m_2)}, \tag{6}$$

$$\alpha_0(k, m_1, m_2) = \frac{\|x(k, m_1)\|\|x(k, m_2)\|}{\sqrt{Q^2\gamma^4 + \|x(k, m_1)\|^2\|x(k, m_2)\|^2}}, \tag{7}$$

where an appropriate norm can be used. The signals in equation (7) are not normalized but they can be normalized by $Q\gamma^2$.

The following relates to clustering. Clustering of the observations $\{x(k,m)\}_{k\in\mathcal{K},m\in\mathcal{M}}$ in time can be performed, where $\mathcal{M}$ is a sequence of subsequent time indices. Based on the similarity matrix, each cluster gathers the time instants in $\mathcal{M}$ where a particular source is active in the band $\mathcal{K}$.

The definition of the similarity matrix in equation (2) can be seen as an overall kernelization of the similarity metric. The kernelization can allow one to select an appropriate similarity metric and forms an important attribute of the clustering algorithm. The next step can be to decide on a clustering algorithm that operates on the similarity matrix.

One approach for clustering based on a similarity matrix is spectral clustering. This can be used in some implementations. Spectral clustering methods do not use the notion of an exemplar or centroid for a cluster, but instead separate regions of relatively high data density by regions of relatively low data density.

The property of spectral clustering that clusters are separated by low data density regions may be undesirable for some implementations. Although this happens sparingly because of the large dynamic range of speech, the simultaneous activity of multiple sources can generate some observations where the relative transfer function is a linear mixture with similarly-sized contributions of the transfer functions of the distinct sources. Such data points can "bridge" the dense relative transfer function regions of the individual sources. Hence, spectral clustering sometimes combines distinct sound sources into a single cluster. This disadvantage can outweigh the advantage of spectral clustering that it can track a slowly moving source.

To avoid the problem of linking distinct sources, one can use an exemplar or centroid based clustering approach. However, one might like to retain the flexibility in the similarity metric, and hence combine the exemplar or centroid based approach with the earlier kernelized similarity measure. A centroid based kernelized approach exists, and exemplar based kernelized approaches are the Markov cluster algorithm and affinity propagation. In both the Markov cluster algorithm and in the affinity propagation the number of clusters (sources) does not need to be prescribed. Some implementations having nothing to do with BSS use the affinity propagation approach, but the Markov cluster algorithm may perform better at least under some circumstances.

The outcome of the clustering process is an indicator function $I_{p\mathcal{K}}: \mathcal{M} \rightarrow \{0, 1\}$ for a frequency band $\mathcal{K}$ that indicates for which time instants $m \in \mathcal{M}$ cluster $p \in \mathcal{P}$ is active. As the clustering is performed per band, the computational effort is low if the number of bands is small. In many scenarios only a single band for computation of the clustering suffices. If multiple bands are used, the band clusters can be linked together to define wide-band source by performing a cross-correlation on the indicator functions, as discussed below. The BSS component 200 can include a clustering component 240 that performs some or all of the above calculations.

Figure 3:
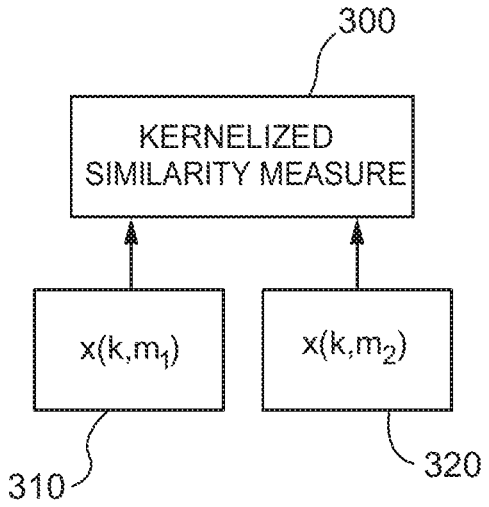
FIG. 3 shows an example of a kernelized similarity measure.

FIG. 3 shows an example of a kernelized similarity measure 300. In some implementations, the kernelized similarity measure 300 can be used in a similarity determination, such as using equation (5). For example, an input 310 corresponding to $x(k, m_1)$ and an input 320 corresponding to $x(k, m_2)$ can be provided to the measure 300. In some implementations, multiple instances of the kernelized similarity measure 300 are combined by summing over k to obtain a similarity measure for time-instants for the entire frequency band.

Figure 4A:
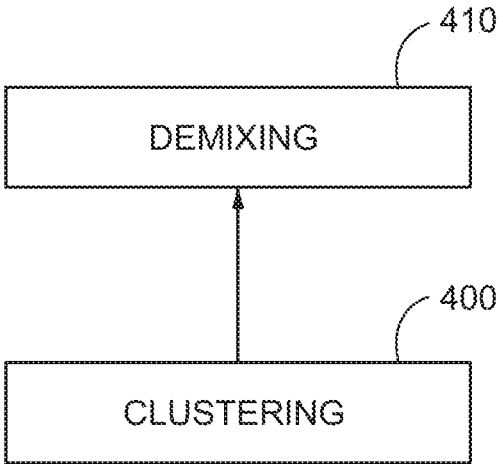
FIG. 4A shows an example of clustering and demixing.

The following description relates to demixing signals. The outcome of the clustering can be used in at least two ways. A first approach uses the clustering outcome directly for demixing in time only. FIG. 4A shows an example of clustering and demixing. A clustering component 400 can perform clustering, for example as described herein. A demixing component 410 can perform demixing based on input from the clustering component 400.

Figure 4B:
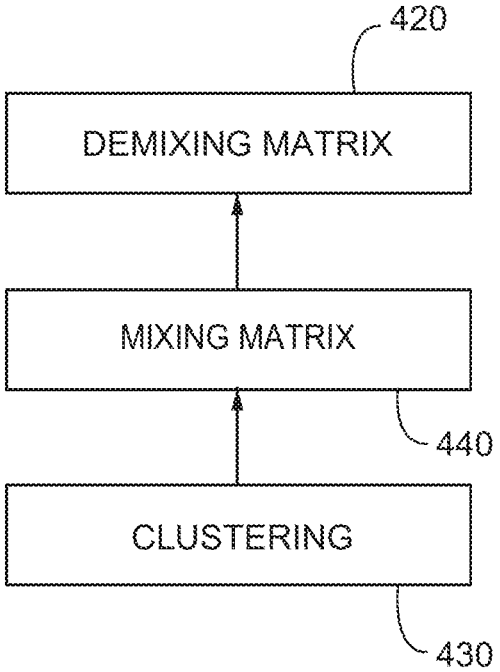
FIG. 4B shows an example of a demixing matrix.

A second approach uses the clustering process as a pre-processing step. For example, it first computes a mixing matrix for each frequency k and then determines the demixing matrix from the mixing matrix either by using a pseudo-inverse or more sophisticated methods such as the one described below. One can improve the second approach further by postprocessing where required. FIG. 4B shows an example of a demixing matrix 420. For example, a clustering component 430 can provide pre-processing to a mixing matrix 440, from which the demixing matrix 420 is determined.

The following relates to nonlinear demixing in time. If only a single frequency band $\mathcal{K}$ is used, then one can associate the time segments m corresponding to the sequence of time observations belonging to a cluster associated with a particular sound source p using the indicator function $I_{p\mathcal{K}}$. The sequences of masked observations $$x(k,m)\, I_{p\mathcal{K}}(m) \tag{8}$$

with a particular sound-source (cluster) p can then be placed in a single stream for each frequency bin k. One can then perform the inverse time-frequency transform $\mathcal{F}^{-1}$ on this stream and play out a particular scalar channel i of the vector signal: $(\mathcal{F}^{-1}x(k, m)\, I_{p\mathcal{K}}(m))_i(n)$ where n is time. This represents the source p as observed by microphone i at time sample n. The availability of multi-channel signals for the single source facilitates the application of dereverberation algorithms.

The quality of nonlinear demixing in time can be excellent when the source signals do not overlap in time. Hence the approach can perform well in a meeting scenario. For time segments where the talkers talk simultaneously, the system switches rapidly in time. The performance can then deteriorate rapidly with the number of talkers.

The following relates to finding the mixing matrices for the frequency bins: The mixing matrix can be found for each frequency bin. One can here assume that all bins must be considered separately, which is the case if the microphones are sufficiently far apart. It may be possible to exploit relations between matrices in frequency. One can first process the signal using the clustering method described above in each of a set of L disjoint frequency bands $\{\mathcal{K}_1, \ldots, \mathcal{K}_L\}$. Each frequency bin k must be assigned to a band $\mathcal{K}_1$. It is natural to associate a bin k to the band $\mathcal{K}_1$ that it is contained in, or the band that it is closest to. Note again that a single frequency band may suffice. Below are described three methods for computing the mixing matrix.

The following describes an exemplar based mixing matrix which can advantageously be used. The exemplar for each cluster p in a band $\mathcal{K}$ contains an observation vector for each frequency bin k that is within $\mathcal{K}$. Conjugating and normalizing this vector to unit length provides a row p of a mixing matrix A(k). For frequency bins associated with $\mathcal{K}$ but not in $\mathcal{K}$, one can take the observation vector associated with the time instant corresponding to the exemplar of cluster p. The exemplar-based determination of the mixing matrix will not be accurate for the frequency bins where the source p has low signal power in the exemplar.

The following describes a singular value decomposition (SVD) based mixing matrix. For a frequency bin k associated with a band $\mathcal{K}_1$ one can identify the time-frequency observations that correspond to a particular source. Let $\mathcal{M}_p$ be the set of time instants associated with a cluster p in band $\mathcal{K}_1$. One can perform a singular value decomposition on the matrix of concatenated observation vectors $X^{(p)}(k)=\{x(k,m)\}_{m\in\mathcal{M}_p}$ for a frequency k to obtain the row of the mixing matrix A(k) for that particular source. It may be possible to improve the result by omitting time instants that have relatively low similarity to the exemplar, as indicated by the similarity matrix.

Omitting the frequency and band related indices to ease the notation, the singular value decomposition can be written as $$X^{(p)}=U^{(p)}D^{(p)}V^{(p)H}, \tag{9}$$

where $U^{(p)}\in\mathbb{R}^{Q\times Q}$ and $V^{(p)}\in\mathbb{R}^{|\mathcal{M}|\times|\mathcal{M}|}$ are unitary, where absolute signs $|\bullet|$ indicate the cardinality of the set, and $D^{(p)}\in\mathbb{R}^{Q\times|\mathcal{M}|}$ is diagonal, Let $D_{11}^{(p)}$ be the largest coefficient of $D^{(p)}$ Then the first columns of $U^{(p)}$ and $V^{(p)}$, which are here denoted as $U_{\cdot 1}^{(p)}$ and $V_{\cdot 1}^{(p)}$, specify the best rank-1 approximation of $X^{(p)}$:

$$X^{(p)}\approx D_{11}^{(p)}U_{\cdot 1}^{(p)}V_{\cdot 1}^{(p)H}, \tag{10}$$

where one can interpret $U_{\cdot 1}^{(p)}$ as the relative transfer function and $V_{\cdot 1}^{(p)}$ as the driving signal for the cluster. One can now build the conjugate transpose of the mixing matrix for the frequency bin k as $$A^H(k)=\{U_{\cdot 1}^{(p)}\}_{p\in\mathcal{P}}, \tag{11}$$

where all frequency and band indices have been omitted.

The following describes a normalized averaging based mixing matrix. A somewhat less accurate but low-computational-complexity alternative for obtaining the relative transfer function for cluster p is $$A_{p\cdot}^H(k)=\frac{1}{|\mathcal{M}_p|}\sum_{m\in\mathcal{M}_p}\frac{1}{x_1(k,m)}x(k,m)g_{\alpha_0}(\|x(k,m)\|) \tag{12}$$

where $g_{\alpha_0}:[0,\infty)\rightarrow[0,1]$ is a sigmoidal function with parameterization $\alpha_0$, and where the observation is normalized by its first coefficient $x_1$ (k, m) and where an appropriate norm is used.

The following describes pseudo-inverse based linear demixing. A demixing matrix W(k) of a frequency bin k can be computed from the mixing matrix A(k) by means of the pseudo-inverse. The pseudo-inverse minimizes the unexplained variance in the observation vectors X(k, m) for the overdetermined case, $Q\geq\mathcal{P}^3$, that is considered in this example. Thus, one can obtain a set of source signals $p\in\mathcal{P}$ each associated with a band $\mathcal{K}$. The source signals for the frequency bins k can now be determined as $$s(k,m)=W(k)x(k,m). \tag{13}$$

The pseudo-inverse can lead to poor results if the true steering vectors are not aligned with the estimated rows of mixing matrix. This problem can be removed by rescaling the rows of the demixing matrix to unit norm. The resulting method can be interpreted as a projection onto the component of the row of the mixing matrix that is orthogonal to the other rows (i.e., the estimated steering vectors) of the other sources, followed by a renormalization.

One can further enhance the demixed signals individually by considering the local-in-time scenario. Consider the extraction of one particular talker in a particular time segment in a meeting scenario. In this time segment most of the other talkers may not be present. It is an inefficient use of the available resources to attempt to suppress interfering sources based on global estimates. Instead one can account for local noise and variations in the interferer locations.

Accounting for interference as present locally-in-time can be done. With some abuse of notation, let $\mathcal{N}^{(s)}$ describe the local time segment. Some aspects of certain implementations resemble generalized side-lobe cancellation and, hence, the final stage used in a generalized beamforming method. Similarly to a generalized side-lobe canceller, one can define as interference the signal that lies in the null space $\mathcal{N}(A_{p\cdot})$ of the generalized steering vector $A_{p\cdot}$ of source p. Hence one has obtained a $|\mathcal{M}^{(s)}|\times(Q-1)$ dimensional local-in-time interference signal x(k, m) $\mathcal{N}(A_{p\cdot})$, $m\in\mathcal{M}_s$. The enhanced source signal in the local time segment, $s^{(s)}(k, m)$, is then found by removing the signal component correlated to the $Q-1$ dimensional inference process in that time segment:

$$s_p^{(s)}(k,m)=s_p(k,m)-x(k,m)\mathcal{N}(A_{p\cdot})b \tag{14}$$

where $$b=\underset{b\in\mathbb{R}^{(Q-1)\times 1}}{\operatorname{argmin}}\sum_{m\in\mathcal{M}_s}\|s_p(k,m)-x(k,m)\mathcal{N}(A_{p\cdot})b\|^2.$$

Low variance of the interference process can identify where the interference process is dominated by leakage of the desired source because of misalignment of the real and estimated steering vectors. When the interference process has low variance, the second term in equation (14) can be omitted.

The boundaries of the time segments used for the enhancement approach can be selected based on the behavior of the similarity matrix. The similarity matrix can show when different sources and combinations of sources are active, and the boundaries of such regions can be used to select the time segments. The set $\mathcal{M}_{p\mathcal{K}}$ may not be used directly as it does not flag mixtures.

The following relates to a minimum-variance distortionless response based linear demixing, which is a different approach than the one described just above. The performance of straightforward linear demixing based on the pseudo-inverse can be relatively poor when evaluated in terms of signal to interference ratio for the extracted sources. In some implementations, a method can perform better, particularly when one or more of the following conditions occurs: i) the number of sources P is small and the observation dimensionality $Q$ is high, ii) the sources are intermittently active (e.g., talkers in a meeting, or instruments in a song), iii) the background noise has a nonuniform spatial profile.

As an example, consider the extraction of one particular source in a particular time segment. Some of the interfering sources may not be present in the selected time segment. It may be an inefficient use of resources (the degrees of freedom in the demixing vector, which is linearly related to the number of microphones minus the one degree of freedom used up by the desired source) to suppress sources that are not present.

Consider a particular time segment, a particular source p, and a frequency bin k. Let $R_N(k)$ be the empirical covariance matrix of the microphones without the contribution of the source p for the segment. Let $R_X(k)$ be the empirical covariance matrix of the microphones for the segment. Hence one has that $R_X(k)=R_N(k)+A_{p\cdot}^H(k)A_{p\cdot}(k)$. The linear minimum-variance distortionless response (MVDR) estimator is then, for source p, $$W_{p\cdot}^H(k) = \frac{R_X^{-1}(k)A_{p\cdot}^H(k)}{A_{p\cdot}R_X^{-1}(k)A_{p\cdot}^H(k)} \tag{15}$$

$$= \frac{R_N^{-1}(k)A_{p\cdot}^H(k)}{A_{p\cdot}(k)R_N^{-1}(k)A_{p\cdot}^H(k)}. \tag{16}$$

The equality of equations (15) and (16) follows from the Woodbury matrix identity. Both equations (15) and (16) can be used to extract a particular source given its relative transfer function $A_{p\cdot}^H(k)$. This principle is similar to the application of the generalized side-lobe canceller to the relative transfer function in the beamformer.

$R_X(k)$ may be simple to evaluate and equation (15) can be generalized to the MVDR based source separation $$W^H(k)=GR_X^{-1}(k)A^H, \tag{17}$$

where G is a diagonal matrix with elements $G_{p\cdot}=(A_{p\cdot}(k)R_X^{-1}(k)A_{p\cdot}^H(k))^{-1}$. Equation (17) is here different from the standard pseudo-inverse of A(k). Moreover, in some implementations the mixing matrix A(k) is advantageously estimated over longer intervals, whereas the covariance matrices $R_X(k)$ and equation (17) are evaluated for shorter time intervals. The demixing matrix can be used to obtain the sources using equation (13).

The time segments can be selected based on the behavior of the similarity matrix. The similarity matrix can generally show clearly when the mixture of sources changes.

The following relates to nonlinear postprocessing. One can improve on the linear demixing methods, whether obtained with the pseudo-inverse or the MVDR paradigm, using a postprocessing operation. The postprocessing operation is aimed at reducing or removing signal leakage to the extracted signal for a source p when that source is not active. Leakage is often present because the p'th row $W_{p\cdot}$ of W is not perfectly orthogonal to the relative transfer function of active sources.

Consider a time instant m and band $\mathcal{K}$. Let $\{x(k,m_p)\}_{k\in\mathcal{K}}$ be the exemplar for cluster (source) p. One can then augment the demixing in equation (13) as follows:

$$s_p(k,m)=W_{p\omega}x(k,m)g_{\alpha_1}(\mathcal{S}_{\mathcal{K}}(m,m_p)), \tag{18}$$

where $g_{\alpha_1}$ is the previously introduced sigmoidal function with a distinct parameterization $\alpha_1$ and where one wrote the demixing for a source p. The last factor in equation (18) should suppress the output of channel p only for a subset of the time instants where the indicator function for source p vanishes, $I_{p\mathcal{K}}=0$, i.e., for time instants not belonging to cluster p.

Equation (18) restricts the effect of postprocessing to time instants in the band that resemble the exemplar. For complex shaped clusters one can replace the exemplar in equation (18) by the nearest neighbor time instant in the cluster. where $$s_p(k,m) = W_{p\cdot}x(k,m)g_{\alpha_1}(\min_{n\in\mathcal{M}_{p\mathcal{K}}}\mathcal{S}_{\mathcal{K}}(m,n)), \tag{19}$$

$$\mathcal{M}_{p\mathcal{K}} = \{m \mid I_{p\mathcal{K}}(m) = 1\}.$$

(19)

The following describes source permutation across bands. The correspondence of the sources identified in the different frequency bands must be determined needs to be known if more than one band is used. This is a relatively straightforward. For a band $\mathcal{K}_0$ that provides a reliable source identification, one can select subsequent sources (clusters) p and cross-correlate its indicator function $I_{p\mathcal{K}_0}(m)$ with the indicator functions of sources q in other bands $I_{q,\mathcal{K}_l}(m)$; the maximum cross correlation identifies the correct permutation pair (p, q). If the other bands have fewer sources, one can simply omit that signal from those bands. If there are more sources, they are considered noise and not considered in the separation process.

The following describes recursive processing. Above has been described source separation for a block of data. In some scenarios it is desirable to obtain the separated source signals with a minimal delay. In other cases the scenario is dynamic and needs to be adapted over time. Straightforward adjustments facilitate this possibility.

Here is first described a generalization of the basic clustering procedure above to minimize delay. Consider the clustering in a band $\mathcal{K}$. It can be reasonable to perform clustering on a subset of the data. The use of a subset of data for clustering can lead to two extensions of the clustering operation. First, one must be able to associate a data point with an existing exemplar even if that data point was not used in the corresponding clustering operation. Second, one must be able to link exemplars of different clustering operations that correspond to identical sources.

Here is first discussed the association of a new data point with a cluster. With nearest-neighbor based clustering methods this is a straightforward selection of the nearest centroid.

However, this approach may not be accurate for exemplar-based algorithms such as the Markov cluster algorithm and the affinity propagation algorithm. For the exemplar-based algorithms rather than seeking the nearest centroid, it may be appropriate to retain the entire cluster and seek the nearest neighbor in the cluster in such cases. The cluster needs to be of sufficient size.

Next is discussed the linking of exemplars between different clustering operations. The simplest approach to linking existing exemplars to a new clustering operation may be to include the exemplars as a data point in the new clustering operation and find the cluster they are included into. As the number of clusters is not preset in either the Markov cluster algorithm or the affinity propagation algorithm new clusters can be added that correspond to sources that did not occur before in the data set. In fact, it may be natural to retain the exemplars, if possible with the associated data points (clusters) for each clustering operation, as well as the links between the exemplars of different clustering operations. Inconsistent linkages can occur that link clusters within a subset through clusters in other subsets. It may then be natural to break the links between clusters that are weakest according to the similarity measure in the corresponding similarity matrix.

The ability to use of a subset of the data allows one to introduce a time constraint for the subset. That is, one can determine an update rule that selects a time interval $[t_0, t_1]$ for clustering for each subsequent time instant t for which a cluster association is being sought, where $t_0 \leq t \leq t_1$. It is natural for a sequence of subsequent time instants to share a single clustering operation to save computation effort. The algorithmic delay is the maximum of the difference $t_1 - t$ over all t being processed. Increased delay and an appropriate interval length will improve the ability of the separation system to handle scenarios that are not time-invariant (moving sources, the appearance and disappearance of sources).

It may now be straightforward to generalize the separation in time only as described above to recursive processing. This separation approach may use only one frequency band and each time instant of the time-frequency representation may be associated with a particular exemplar. Hence, the application of (8) is all that remains. The generalization to recursive processing of linear demixing above with or without the postprocessing and depermutation as described above may also be straightforward. Once the time-instant of a frequency band is associated with a cluster in the band, then the demixing matrix and depermutation are known. To obtain a postprocessing weighting, the corresponding an "equivalent" similarity matrix entry to the exemplar can be computed.

Figure 5:
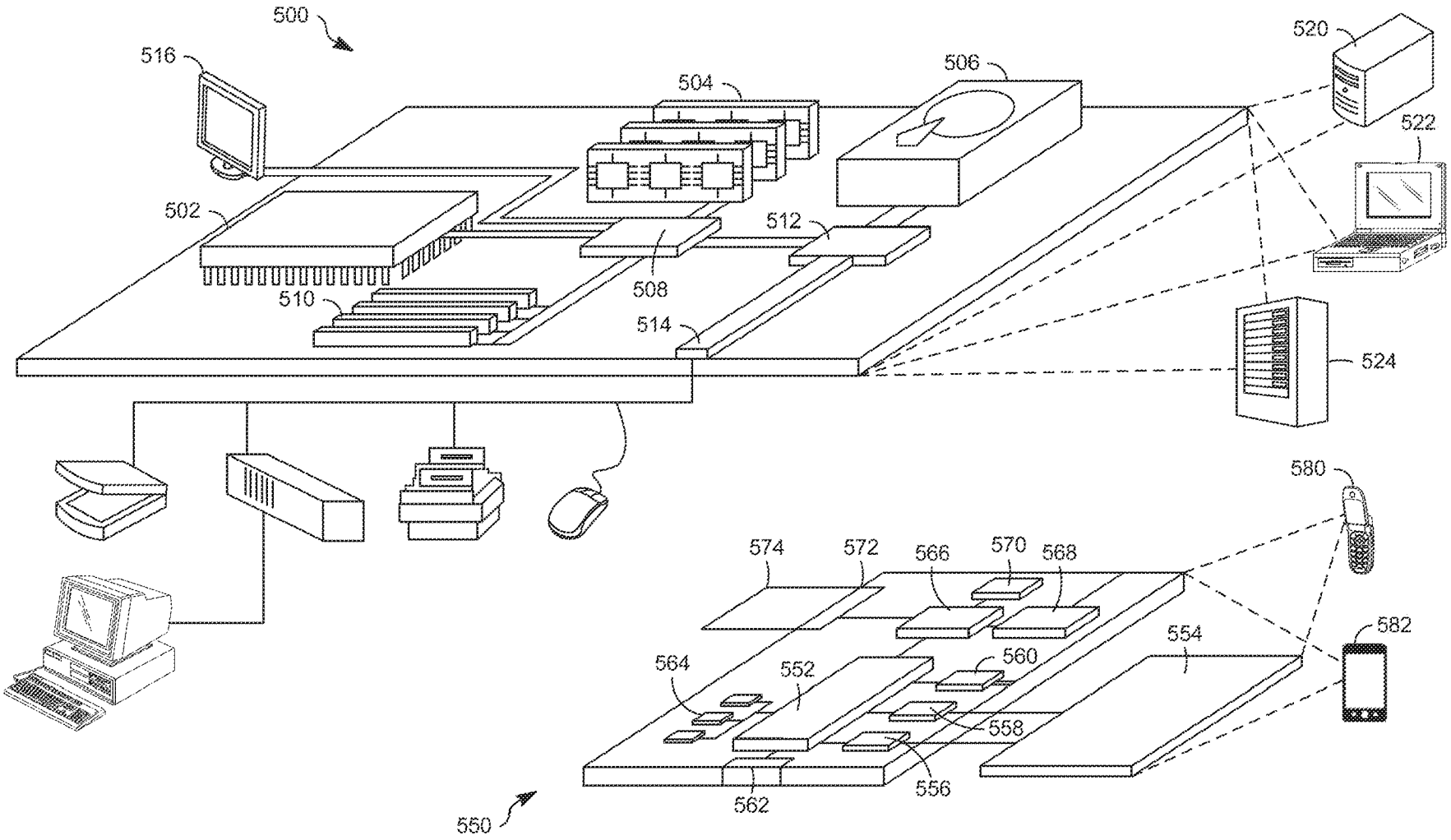
FIG. 5 shows an example of a computer device and a mobile computer device that can be used to implement the techniques described here.

FIG. 5 shows an example of a generic computer device 500 and a generic mobile computer device 550, which may be used with the techniques described here. Computing device 500 is intended to represent various forms of digital computers, such as laptops, desktops, tablets, workstations, personal digital assistants, televisions, servers, blade servers, mainframes, and other appropriate computing devices. Computing device 550 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 500 includes a processor 502, memory 504, a storage device 506, a high-speed interface 508 connecting to memory 504 and high-speed expansion ports 510, and a low speed interface 512 connecting to low speed bus 514 and storage device 506. The processor 502 can be a semiconductor-based processor. The memory 504 can be a semiconductor-based memory. Each of the components 502, 504, 506, 508, 510, and 512, are interconnected using various busses, and may be mounted on a common motherboard or in other manners as appropriate. The processor 502 can process instructions for execution within the computing device 500, including instructions stored in the memory 504 or on the storage device 506 to display graphical information for a GUI on an external input/output device, such as display 516 coupled to high speed interface 508. In other implementations, multiple processors and/or multiple buses may be used, as appropriate, along with multiple memories and types of memory. Also, multiple computing devices 500 may be connected, with each device providing portions of the necessary operations (e.g., as a server bank, a group of blade servers, or a multi-processor system).

The memory 504 stores information within the computing device 500. In one implementation, the memory 504 is a volatile memory unit or units. In another implementation, the memory 504 is a non-volatile memory unit or units. The memory 504 may also be another form of computer-readable medium, such as a magnetic or optical disk.

The storage device 506 is capable of providing mass storage for the computing device 500. In one implementation, the storage device 506 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 504, the storage device 506, or memory on processor 502.

The high speed controller 508 manages bandwidth-intensive operations for the computing device 500, while the low speed controller 512 manages lower bandwidth-intensive operations. Such allocation of functions is exemplary only. In one implementation, the high-speed controller 508 is coupled to memory 504, display 516 (e.g., through a graphics processor or accelerator), and to high-speed expansion ports 510, which may accept various expansion cards (not shown). In the implementation, low-speed controller 512 is coupled to storage device 506 and low-speed expansion port 514. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 500 may be implemented in a number of different forms, as shown in the figure. For example, it may be implemented as a standard server 520, or multiple times in a group of such servers. It may also be implemented as part of a rack server system 524. In addition, it may be implemented in a personal computer such as a laptop computer 522. Alternatively, components from computing device 500 may be combined with other components in a mobile device (not shown), such as device 550. Each of such devices may contain one or more of computing device 500, 550, and an entire system may be made up of multiple computing devices 500, 550 communicating with each other.

Computing device 550 includes a processor 552, memory 564, an input/output device such as a display 554, a communication interface 566, and a transceiver 568, among other components. The device 550 may also be provided with a storage device, such as a microdrive or other device, to provide additional storage. Each of the components 550, 552, 564, 554, 566, and 568, are interconnected using various buses, and several of the components may be mounted on a common motherboard or in other manners as appropriate.

The processor 552 can execute instructions within the computing device 550, including instructions stored in the memory 564. The processor may be implemented as a chipset of chips that include separate and multiple analog and digital processors. The processor may provide, for example, for coordination of the other components of the device 550, such as control of user interfaces, applications run by device 550, and wireless communication by device 550.

Processor 552 may communicate with a user through control interface 558 and display interface 556 coupled to a display 554. The display 554 may be, for example, a TFT LCD (Thin-Film-Transistor Liquid Crystal Display) or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may be provide in communication with processor 552, so as to enable near area communication of device 550 with other devices. External interface 562 may provide, for example, for wired communication in some implementations, or for wireless communication in other implementations, and multiple interfaces may also be used.

The memory 564 stores information within the computing device 550. The memory 564 can be implemented as one or more of a computer-readable medium or media, a volatile memory unit or units, or a non-volatile memory unit or units. Expansion memory 574 may also be provided and connected to device 550 through expansion interface 572, which may include, for example, a SIMM (Single In Line Memory Module) card interface. Such expansion memory 574 may provide extra storage space for device 550, or may also store applications or other information for device 550. Specifically, expansion memory 574 may include instructions to carry out or supplement the processes described above, and may include secure information also. Thus, for example, expansion memory 574 may be provide as a security module for device 550, and may be programmed with instructions that permit secure use of device 550. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 564, expansion memory 574, or memory on processor 552, that may be received, for example, over transceiver 568 or external interface 562.

Device 550 may communicate wirelessly through communication interface 566, which may include digital signal processing circuitry where necessary. Communication interface 566 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 568. In addition, short-range communication may occur, such as using a Bluetooth, WiFi, or other such transceiver (not shown). In addition, GPS (Global Positioning System) receiver module 570 may provide additional navigation- and location-related wireless data to device 550, which may be used as appropriate by applications running on device 550.

Device 550 may also communicate audibly using audio codec 560, which may receive spoken information from a user and convert it to usable digital information. Audio codec 560 may likewise generate audible sound for a user, such as through a loudspeaker, e.g., in a handset of device 550. Such sound may include sound from voice telephone calls, may include recorded sound (e.g., voice messages, music files, etc.) and may also include sound generated by applications operating on device 550.

The computing device 550 may be implemented in a number of different forms, as shown in the figure. For example, it may be implemented as a cellular telephone 580. It may also be implemented as part of a smart phone 582, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

A number of embodiments have been described. Nevertheless, it will be understood that various modifications may be made without departing from the spirit and scope of the invention.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A method comprising:

receiving time instants of electronic audio signals generated by a set of microphones at a location;

determining a distortion measure between frequency components of at least some of the received electronic audio signals;

determining similarity measures for the frequency components using the determined distortion measure, the similarity measures measuring a similarity of the electronic audio signals at different time instants for respective frequency bins; and performing blind source separation of the electronic audio signals, the blind source separation including processing the electronic audio signals based on the determined similarity measure, including aggregating the similarity measures over a frequency band corresponding to the frequency bins.

2. The method of claim 1, wherein determining the distortion measure comprises determining a correlation measure of vector directionality that relates events at different times.

3. The method of claim 2, wherein the correlation measure includes a distance computation based on inner product.

4. The method of claim 1, wherein the similarity measures comprise kernelized similarity measures.

5. The method of claim 1, further comprising applying a weighting to the similarity measures, the weighting corresponding to relative importance across a band of frequency components for a time pair.

6. The method of claim 1, the method further comprising generating a similarity matrix for the frequency components based on the determined similarity measures.

7. The method of claim 6, further comprising performing clustering using the generated similarity matrix, the clustering indicating for which time segments a particular cluster is active, the cluster corresponding to a source of sound at the location.

8. The method of claim 7, wherein performing the clustering comprises performing centroid-based clustering.

9. The method of claim 7, wherein performing the clustering comprises performing exemplar-based clustering.

10. The method of claim 7, further comprising using the clustering to perform demixing in time.

11. The method of claim 7, further comprising using the clustering as a pre-processing step.

12. The method of claim 11, further comprising computing a mixing matrix for each frequency and then determining a demixing matrix from the mixing matrix.

13. The method of claim 12, wherein determining the demixing matrix comprises using a pseudo-inverse of the mixing matrix.

14. The method of claim 12, wherein determining the demixing matrix comprises using a minimum-variance demixing.

15. The method of claim 1, wherein the processing of the audio signals comprises speech recognition of participants.

16. The method of claim 1, wherein the processing of the audio signals comprises performing a search of the electronic audio signal for audio content from a participant.

17. A computer program product tangibly embodied in a non-transitory storage medium, the computer program product including instructions that when executed cause a processor to perform operations including:

receiving time instants of audio signals generated by a set of microphones at a location;

determining a distortion measure between frequency components of at least some of the received audio signals;

determining similarity measures for the frequency components using the determined distortion measure, the similarity measures measuring a similarity of the audio signals at different time instants for respective frequency bins; and performing blind source separation of the audio signals, the blind source separation including processing the audio signals based on the determined similarity measure, including aggregating the similarity measures over a frequency band corresponding to the frequency bins.

18. The computer program product of claim 17, wherein the similarity measures comprise kernelized similarity measures.

19. A system comprising:

a processor; and a computer program product tangibly embodied in a non-transitory storage medium, the computer program product including instructions that when executed cause the processor to perform operations including:

receiving time instants of audio signals generated by a set of microphones at a location;

determining a distortion measure between frequency components of at least some of the received audio signals;

determining similarity measures for the frequency components using the determined distortion measure, the similarity measures measuring a similarity of the audio signals at different time instants for respective frequency bins; and performing blind source separation of the audio signals, the blind source separation including processing the audio signals based on the determined similarity measure, including aggregating the similarity measures over a frequency band corresponding to the frequency bins.

20. The system of claim 19, wherein the similarity measures comprise kernelized similarity measures.

* * * * *